US010111466B2

(12) United States Patent
Lord

(10) Patent No.: US 10,111,466 B2
(45) Date of Patent: Oct. 30, 2018

(54) ELECTRONIC CIGARETTE

(71) Applicant: NICOVENTURES HOLDINGS LIMITED, London (GB)

(72) Inventor: Christopher Lord, London (GB)

(73) Assignee: Nicoventures Holdings Limited, London (GB)

( * ) Notice: Subject to any disclaimer, the term of this patent is extended or adjusted under 35 U.S.C. 154(b) by 110 days.

(21) Appl. No.: 14/787,946

(22) PCT Filed: Apr. 30, 2014

(86) PCT No.: PCT/GB2014/051333

§ 371 (c)(1),
(2) Date: Oct. 29, 2015

(87) PCT Pub. No.: WO2014/177860

PCT Pub. Date: Jun. 11, 2014

(65) Prior Publication Data

US 2016/0106154 A1 Apr. 21, 2016

(30) Foreign Application Priority Data

May 2, 2013 (GB) ..... 1307966.0

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | |
|---|---|---|---|
| 228,598 | A | 6/1880 | Buckley |
| 353,327 | A | 11/1886 | Randolph |
| 576,653 | A | 2/1897 | Bowlby |
| 595,070 | A | 12/1897 | Oldenbusch |

(Continued)

FOREIGN PATENT DOCUMENTS

| | | |
|---|---|---|
| AT | 507 187 | 3/2010 |
| AT | 508244 | 12/2010 |

(Continued)

OTHER PUBLICATIONS

PCT International Search Report and Written Opinion for PCT/GB2014/051333, dated Jul. 17, 2014, 10 pgs.

(Continued)

*Primary Examiner* — Eric Yaary
(74) *Attorney, Agent, or Firm* — Patterson Thuente Pedersen, P.A.

(57) ABSTRACT

An electronic cigarette has a vaporizer to produce vapor to be delivered to its mouth end. The vaporizer includes a tube having inlet and outlet ends. A porous matrix containing a vaporizable liquid, extends around the tube. Wicking fibers extend through side openings in the tube and are configured to wick the vaporizable liquid from the porous matrix into the tube, and electrical heater coil is powered by a battery to vaporize liquid on the wicking fibers in the tube, so that vapor is supplied along the tube end when the user draws on mouth end. An airflow restrictor is provided to accelerate the flow of air along the tube to the heater coil.

20 Claims, 6 Drawing Sheets

(56) References Cited

U.S. PATENT DOCUMENTS 744,074 A 11/1903 Hiering
799,844 A 9/1905 Fuller
885,374 A 4/1908 Pohlig
1,163,183 A 12/1915 Stoll
D53,386 S 5/1919 Thomas
1,436,157 A 11/1922 Fazio
1,807,936 A 6/1931 Saunders
1,815,069 A 7/1931 Petro
1,937,120 A 11/1933 Lagerholm
1,937,987 A 12/1933 Sexton
2,057,353 A 10/1936 Whittemore, Jr.
2,262,318 A 11/1941 Fox
2,411,946 A 12/1946 Vogel
2,467,923 A 4/1949 Allen
2,483,304 A 9/1949 Vogel
2,522,952 A 9/1950 Krohn
2,658,368 A 11/1953 Siegal
2,782,910 A 2/1957 Liebow
2,809,634 A 10/1957 Murai
3,111,396 A 11/1963 Ball
3,165,225 A 1/1965 Reitzel
3,402,724 A 9/1968 Blount
3,431,393 A 3/1969 Katsuda
3,433,632 A 3/1969 Elbert et al.
3,521,643 A 7/1970 Toth
3,604,428 A * 9/1971 Moukaddem ..... A24D 3/045 131/201
3,722,742 A 3/1973 Wertz
3,743,136 A 7/1973 Chambers
3,804,100 A 4/1974 Fariello
3,861,523 A 1/1975 Fountain et al.
3,863,803 A 2/1975 Valcic
3,964,902 A 6/1976 Fletcher et al.
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,190,412 A 2/1980 Tokai
4,193,513 A 3/1980 Bull
4,214,658 A 7/1980 Crow
4,503,851 A 3/1985 Braqunroth et al.
D279,508 S 7/1985 Bauer et al.
4,588,976 A 5/1986 Jaselli
4,676,237 A 6/1987 Wood et al.
4,733,794 A 3/1988 Kent
4,735,217 A 4/1988 Gerth et al.
4,753,383 A 6/1988 Focke et al.
4,793,478 A 12/1988 Tudor
4,830,028 A 5/1989 Lawson et al.
4,848,374 A 7/1989 Chard et al.
4,885,129 A 12/1989 Leonard et al.
4,917,301 A 4/1990 Munteanu
4,922,901 A 5/1990 Brooks et al.
4,923,059 A 5/1990 Evers et al.
4,947,874 A 8/1990 Brooks et al.
4,947,875 A 8/1990 Brooks et al.
4,961,438 A 10/1990 Korte
4,978,814 A 12/1990 Honour
5,027,837 A 7/1991 Clearman et al.
5,044,550 A 9/1991 Lamm
5,046,514 A 9/1991 Bolt
5,060,671 A 10/1991 Counts et al.
D322,687 S 12/1991 Tschudin
5,095,647 A 3/1992 Zobele et al.
5,095,921 A 3/1992 Losee et al.
5,099,861 A 3/1992 Clearman et al.
5,121,881 A 6/1992 Lembeck
5,167,242 A 12/1992 Turner et al.
5,179,966 A 1/1993 Losee et al.
5,247,947 A 9/1993 Clearman et al.
D346,878 S 5/1994 Gee et al.
5,322,075 A 6/1994 Deevi et al.
5,388,574 A 2/1995 Ingebrethsen
5,390,864 A 2/1995 Alexander
5,448,317 A 9/1995 Huang
5,479,948 A 1/1996 Counts
5,497,792 A 3/1996 Prasad et al.
5,501,236 A 3/1996 Hill et al.
5,505,214 A 4/1996 Collins et al.
5,540,241 A 7/1996 Kim
5,553,791 A 9/1996 Alexander
5,636,787 A 6/1997 Gowhari
5,649,554 A 7/1997 Sprinkel et al.
5,666,977 A 9/1997 Higgins et al.
5,692,291 A 12/1997 Seetharama
D392,069 S 3/1998 Rowland
5,743,251 A 4/1998 Howell
D404,201 S 1/1999 Wennerstrom
5,865,185 A 2/1999 Collins et al.
5,896,984 A 4/1999 Focke
D414,892 S 10/1999 Chen
5,967,312 A 10/1999 Jacobs
6,065,592 A 5/2000 Wik
6,095,505 A 8/2000 Miller
D432,263 S 10/2000 Issa
D434,217 S 11/2000 Packard et al.
D434,979 S 12/2000 Liu
6,155,268 A 12/2000 Takeuchi
D436,725 S 1/2001 Rogers
D438,003 S 2/2001 Minagawa et al.
D441,133 S 4/2001 Emery
6,275,650 B1 8/2001 Lambert
D449,521 S 10/2001 Pinkus et al.
6,321,757 B1 11/2001 McCutcheon
6,446,793 B1 9/2002 Layshock
D466,012 S 11/2002 Baker
D470,765 S 2/2003 Baker
D471,804 S 3/2003 Staples
D472,012 S 3/2003 South
6,527,166 B1 3/2003 Focke et al.
6,530,495 B1 3/2003 Joseph
6,561,391 B1 5/2003 Baker
6,652,804 B1 11/2003 Neumann et al.
6,681,998 B2 1/2004 Sharpe et al.
6,701,921 B2 3/2004 Spinklel, Jr. et al.
6,715,605 B1 4/2004 Manservigi et al.
D493,617 S 8/2004 Armato
6,790,496 B1 9/2004 Levander et al.
D509,732 S 9/2005 Staples
7,100,618 B2 9/2006 Dominguez
7,112,712 B1 9/2006 Ancell
D545,186 S 6/2007 Liebe et al.
D549,573 S 8/2007 Liebe et al.
7,263,282 B2 8/2007 Meyer
D550,455 S 9/2007 Barnhart
D566,329 S 4/2008 Bagaric et al.
D566,890 S 4/2008 Bagaric et al.
7,389,878 B1 6/2008 Torrico
D573,889 S 7/2008 Short et al.
7,400,940 B2 7/2008 McRae et al.
D575,451 S 8/2008 Jones et al.
7,455,176 B2 11/2008 Focke et al.
7,540,286 B2 6/2009 Cross et al.
7,565,969 B2 7/2009 He
D606,854 S 12/2009 Greenhalgh
D610,983 S 3/2010 Wai et al.
D611,806 S 3/2010 Bried
D613,903 S 4/2010 Wu
D613,904 S 4/2010 Wu
D616,753 S 6/2010 Beam et al.
7,767,698 B2 8/2010 Warchol et al.
7,832,410 B2 11/2010 Hon
D628,469 S 12/2010 Taylor et al.
D631,838 S 2/2011 Cheng
D636,257 S 4/2011 Bougoulas et al.
7,992,554 B2 8/2011 Radomski
D649,658 S 11/2011 Belfrance et al.
D650,738 S 12/2011 Leung
8,113,343 B2 2/2012 Akerlind
D656,094 S 3/2012 Wu
8,156,944 B2 4/2012 Hon
D661,016 S 5/2012 Borges et al.
D671,677 S 11/2012 Wu

(56) References Cited

U.S. PATENT DOCUMENTS

D671,678 S 11/2012 Wu
8,307,834 B1 11/2012 Palmerino, Sr. et al.
D672,642 S 12/2012 Supranowicz
D674,539 S 1/2013 Wu
8,365,742 B2 2/2013 Hon
8,375,957 B2 2/2013 Hon
8,393,331 B2 3/2013 Hon
8,430,106 B2 4/2013 Potter et al.
8,448,783 B2 5/2013 Vecchi
8,490,628 B2 7/2013 Hon
8,511,318 B2 8/2013 Hon
D693,055 S 10/2013 Manca et al.
D700,397 S 2/2014 Manca et al.
8,689,805 B2 4/2014 Hon
8,752,545 B2 6/2014 Buchberger
8,794,245 B1 8/2014 Scatterday
8,833,364 B2 9/2014 Buchberger
D715,760 S 10/2014 Kim et al.
D716,267 S 10/2014 Kim et al.
D720,884 S 1/2015 Liu
8,948,578 B2 2/2015 Buchberger
D723,738 S 3/2015 Liu
D736,460 S 8/2015 McKeon et al.
D737,507 S 8/2015 Liu
9,623,205 B2 4/2017 Buchberger
2001/0042546 A1 11/2001 Umeda et al.
2002/0016370 A1 2/2002 Shytle et al.
2002/0079309 A1 6/2002 Cox et al.
2003/0005620 A1 1/2003 Anath et al.
2003/0049025 A1 3/2003 Neumann et al.
2003/0106552 A1 6/2003 Sprinkel, Jr. et al.
2003/0200964 A1 10/2003 Blakley et al.
2004/0031485 A1 2/2004 Rustad et al.
2004/0056651 A1 3/2004 Marietta
2004/0129793 A1 7/2004 Nguyen et al.
2005/0087460 A1 4/2005 Bruhm et al.
2005/0204799 A1 9/2005 Koch
2005/0211243 A1 9/2005 Esser
2005/0224375 A1 10/2005 Focke et al.
2005/0268911 A1 12/2005 Cross et al.
2006/0078477 A1 4/2006 Althouse
2007/0014549 A1 1/2007 Demarest et al.
2007/0062548 A1 3/2007 Horstmann et al.
2007/0102013 A1 5/2007 Adams et al.
2007/0107879 A1 5/2007 Radomski et al.
2007/0155255 A1 7/2007 Galauner et al.
2007/0193895 A1 8/2007 Weiss et al.
2007/0267032 A1 11/2007 Shan
2008/0017204 A1* 1/2008 Braunshteyn ..... A24D 3/045 131/202
2008/0092912 A1 4/2008 Robinson et al.
2008/0216828 A1 9/2008 Wensley et al.
2008/0223382 A1 9/2008 Zeanah
2008/0241255 A1 10/2008 Rose
2009/0095311 A1 4/2009 Han
2009/0188490 A1 7/2009 Han
2009/0266837 A1 10/2009 Gelardi et al.
2009/0272379 A1 11/2009 Thorens et al.
2009/0288966 A1 11/2009 Minarelli et al.
2009/0293892 A1 12/2009 Williams
2010/0059070 A1 3/2010 Potter et al.
2010/0065653 A1 3/2010 Wingo et al.
2010/0083959 A1 4/2010 Siller
2010/0108059 A1 5/2010 Axelson et al.
2010/0236546 A1 9/2010 Yamada
2010/0313901 A1 12/2010 Fernando et al.
2011/0011396 A1 1/2011 Fang
2011/0036363 A1 2/2011 Urtsev et al.
2011/0126848 A1 6/2011 Zuber et al.
2011/0180433 A1 7/2011 Rennecamp
2011/0226236 A1* 9/2011 Buchberger ..... A61M 11/041 128/200.23
2011/0290267 A1 12/2011 Yamada et al.
2011/0297166 A1 12/2011 Takeuchi et al.
2011/0303231 A1 12/2011 Li et al.
2012/0145169 A1 6/2012 Wu
2012/0199146 A1 8/2012 Marangos
2012/0227752 A1 9/2012 Alelov
2012/0227753 A1 9/2012 Newton
2012/0260927 A1 10/2012 Liu
2012/0285476 A1 11/2012 Hon
2013/0074857 A1 3/2013 Buchberger
2013/0081623 A1 4/2013 Buchberger
2013/0098786 A1 4/2013 Collins
2013/0192615 A1* 8/2013 Tucker ..... H01C 17/00 131/328
2013/0192621 A1* 8/2013 Li ..... H01C 17/00 131/329
2013/0192623 A1* 8/2013 Tucker ..... H01C 17/00 131/329
2013/0213419 A1 8/2013 Tucker et al.
2013/0284192 A1* 10/2013 Peleg ..... A24F 47/002 131/329
2013/0333700 A1 12/2013 Buchberger
2013/0340779 A1* 12/2013 Liu ..... A24F 47/008 131/329
2013/0341218 A1 12/2013 Liu
2013/0342157 A1 12/2013 Liu
2014/0000638 A1 1/2014 Sebastian et al.
2014/0007892 A1 1/2014 Liu
2014/0020697 A1 1/2014 Liu
2014/0048086 A1 2/2014 Zhanghua
2014/0060528 A1* 3/2014 Liu ..... A24F 47/002 128/202.21
2014/0060554 A1 3/2014 Collett et al.
2014/0060555 A1* 3/2014 Chang ..... A24F 47/008 131/329
2014/0196717 A1* 7/2014 Liu ..... A24F 47/008 128/202.21
2014/0196731 A1 7/2014 Scatterday
2014/0202454 A1 7/2014 Buchberger
2014/0209105 A1 7/2014 Sears et al.
2014/0238396 A1 8/2014 Buchberger
2014/0238423 A1 8/2014 Tucker et al.
2014/0238424 A1 8/2014 Macko et al.
2014/0261490 A1* 9/2014 Kane ..... A24F 47/008 131/328
2014/0261495 A1* 9/2014 Novak, III ..... A24F 47/008 131/329
2014/0270730 A1 9/2014 Depiano et al.
2014/0283825 A1 9/2014 Buchberger
2014/0286630 A1 9/2014 Buchberger
2014/0299125 A1 10/2014 Buchberger
2014/0338680 A1 11/2014 Abramov et al.
2015/0114411 A1 4/2015 Buchberger
2015/0208728 A1 7/2015 Lord
2016/0073693 A1 3/2016 Reevell
2016/0101909 A1 4/2016 Schennum et al.
2016/0106154 A1 4/2016 Lord
2016/0106155 A1 4/2016 Reevell
2016/0120218 A1 5/2016 Schennum et al.
2017/0042245 A1 2/2017 Buchberger
2017/0188629 A1 7/2017 Dickens et al.
2017/0197043 A1 7/2017 Buchberger
2017/0197044 A1 7/2017 Buchberger
2017/0197046 A1 7/2017 Buchberger

FOREIGN PATENT DOCUMENTS

AT 510 405 4/2012
AU 63931/73 6/1975
BR 6402132 7/1986
CA 2309376 11/2000
CH 698603 9/2009
CN 2092880 U 1/1992
CN 2220168 Y 2/1996
CN 1312730 12/2001
CN 1329567 1/2002
CN 2485265 4/2002
CN 2660914 12/2004
CN 2719043 Y 8/2005
CN 1703279 A 11/2005
CN 2904674 5/2007

(56) References Cited

FOREIGN PATENT DOCUMENTS

| | | | |
|---|---|---|---|
| CN | 101115901 | | 1/2008 |
| CN | 201023852 | | 2/2008 |
| CN | 201238609 | | 5/2009 |
| CN | 201240612 | Y | 5/2009 |
| CN | 201375023 | | 1/2010 |
| CN | 201430913 | Y | 3/2010 |
| CN | 201592850 | | 9/2010 |
| CN | 101878958 | | 11/2010 |
| CN | 201657770 | U | 12/2010 |
| CN | 102014677 | A | 4/2011 |
| CN | 201830900 | U | 5/2011 |
| CN | 201860753 | U | 6/2011 |
| CN | 102264420 | A | 11/2011 |
| CN | 202122096 | | 1/2012 |
| CN | 202172846 | | 3/2012 |
| CN | 102655773 | | 9/2012 |
| CN | 202 722 498 | U | 2/2013 |
| CN | 202 750 708 | U | 2/2013 |
| CN | 202722498 | | 2/2013 |
| CN | 106102863 | | 11/2016 |
| DE | 594585 | | 3/1934 |
| DE | 1950439 | A1 | 4/1971 |
| DE | 2940797 | | 4/1981 |
| DE | 3148335 | | 7/1983 |
| DE | 3218760 | | 12/1983 |
| DE | 3936687 | | 5/1990 |
| DE | 19630619 | | 2/1998 |
| DE | 19654945 | | 3/1998 |
| DE | 10330681 | | 6/2004 |
| DE | 202006013439 | | 10/2006 |
| DE | 202013100606 | | 2/2013 |
| EP | 0295122 | | 12/1988 |
| EP | 280262 | A2 | 8/1989 |
| EP | 0358002 | A2 | 3/1990 |
| EP | 0358114 | | 5/1990 |
| EP | 0488488 | A1 | 1/1991 |
| EP | 0444553 | A2 | 9/1991 |
| EP | 0845220 | | 6/1998 |
| EP | 0845220 | A1 | 6/1998 |
| EP | 0893071 | | 1/1999 |
| EP | 1166814 | | 1/2002 |
| EP | 1166847 | | 1/2002 |
| EP | 1736065 | | 12/2006 |
| EP | 1820748 | A1 | 8/2007 |
| EP | 1847671 | | 10/2007 |
| EP | 1950439 | | 7/2008 |
| EP | 2018886 | | 1/2009 |
| EP | 2022349 | A1 | 2/2009 |
| EP | 2113178 | | 11/2009 |
| EP | 2340729 | | 7/2011 |
| EP | 2 698 070 | A1 | 2/2014 |
| EP | 2762019 | A1 | 8/2014 |
| EP | 2835062 | A1 | 2/2015 |
| FR | 472030 | | 11/1914 |
| FR | 960469 | | 4/1950 |
| FR | 1292446 | | 5/1962 |
| GB | 30472 | | 12/1909 |
| GB | 191100628 | | 11/1911 |
| GB | 25575 | | 3/1912 |
| GB | 110216 | | 10/1917 |
| GB | 111454 | | 11/1917 |
| GB | 120016 | | 10/1918 |
| GB | 160493 | | 3/1921 |
| GB | 163124 | | 5/1921 |
| GB | 215992 | | 5/1924 |
| GB | 220229 | | 8/1924 |
| GB | 268967 | | 4/1927 |
| GB | 402064 | | 11/1933 |
| GB | 507955 | | 6/1939 |
| GB | 544329 | | 4/1942 |
| GB | 565574 | | 11/1944 |
| GB | 611596 | | 11/1948 |
| GB | 626888 | | 7/1949 |
| GB | 871869 | | 7/1961 |
| GB | 1313525 | | 4/1973 |
| GB | 1046183 | | 7/1988 |
| GB | 2275464 | | 8/1994 |
| GB | 2068034 | | 11/1997 |
| GB | 2369108 | | 5/2002 |
| GB | 4000273 | | 12/2006 |
| GB | 4006615 | | 10/2008 |
| HK | 1196511 | | 12/2014 |
| HK | 1226611 | | 10/2017 |
| JP | S5289386 | A | 7/1977 |
| JP | S57-052456 | A | 3/1982 |
| JP | 57S-140354 | U | 8/1982 |
| JP | S59-106340 | | 1/1986 |
| JP | 61-096765 | | 1/1988 |
| JP | S61-0967735 | | 1/1988 |
| JP | H02-124081 | A | 5/1990 |
| JP | H5-103836 | A | 9/1991 |
| JP | H05-309136 | A | 11/1993 |
| JP | H6-315366 | A | 11/1994 |
| JP | H8-511176 | A | 10/1995 |
| JP | 8299862 | | 11/1996 |
| JP | 11-503912 | | 4/1999 |
| JP | H1189551 | | 4/1999 |
| JP | 3093201 | U | 4/2003 |
| JP | 2004332069 | | 11/2004 |
| JP | 2005-013092 | | 1/2005 |
| JP | 2005-138773 | | 6/2005 |
| JP | 2005-537919 | | 12/2005 |
| JP | 2005-538159 | A | 12/2005 |
| JP | 2007-297124 | | 11/2007 |
| JP | 2009-526714 | | 7/2009 |
| JP | 2011-087569 | | 5/2011 |
| JP | 2011-518567 | | 6/2011 |
| NL | 6617184 | | 6/1967 |
| RU | 2311859 | C2 | 12/2007 |
| RU | 2336001 | C2 | 10/2008 |
| RU | 2360583 | C1 | 7/2009 |
| RU | 89927 | U1 | 12/2009 |
| RU | 94815 | | 6/2010 |
| RU | 103281 | U1 | 4/2011 |
| RU | 115629 | U1 | 5/2012 |
| RU | 121706 | | 11/2012 |
| RU | 122000 | U1 | 11/2012 |
| RU | 124120 | | 1/2013 |
| UA | 78167 | | 3/2013 |
| WO | WO 95/27412 | A1 | 10/1995 |
| WO | WO9632854 | | 10/1996 |
| WO | WO 97/48293 | A1 | 12/1997 |
| WO | WO0009188 | | 2/2000 |
| WO | WO0021598 | | 4/2000 |
| WO | WO 2002/058747 | A1 | 8/2002 |
| WO | WO2002060769 | | 8/2002 |
| WO | WO03028409 | | 4/2003 |
| WO | WO03050405 | | 6/2003 |
| WO | WO2003083283 | | 10/2003 |
| WO | WO 2003101454 | | 12/2003 |
| WO | WO 2004/022242 | | 3/2004 |
| WO | WO2004022243 | | 3/2004 |
| WO | WO2005106350 | | 11/2005 |
| WO | WO2006082571 | | 8/2006 |
| WO | WO2007042941 | | 4/2007 |
| WO | WO2007131449 | | 11/2007 |
| WO | WO2008006048 | | 1/2008 |
| WO | WO2008104870 | | 9/2008 |
| WO | WO2009015410 | | 2/2009 |
| WO | WO2009/092419 | | 9/2009 |
| WO | WO 2009/132793 | | 11/2009 |
| WO | WO2010045670 | | 4/2010 |
| WO | WO2010045671 | | 4/2010 |
| WO | WO 2011/109849 | | 9/2011 |
| WO | WO2011137453 | A2 | 11/2011 |
| WO | WO2012025496 | | 3/2012 |
| WO | WO 2012/065310 | A1 | 5/2012 |
| WO | WO2012065754 | | 5/2012 |
| WO | WO2012114082 | | 8/2012 |
| WO | WO2013034453 | | 3/2013 |
| WO | WO2013034460 | | 3/2013 |
| WO | WO2013045942 | | 4/2013 |
| WO | WO2013057185 | | 4/2013 |
| WO | WO2013098395 | | 7/2013 |

(56) References Cited

FOREIGN PATENT DOCUMENTS

| | | | |
|---|---|---|---|
| WO | WO 2013/116558 | A1 | 8/2013 |
| WO | WO 2014/130695 | A1 | 8/2013 |
| WO | WO2013142671 | | 9/2013 |
| WO | WO2013189050 | | 12/2013 |
| WO | WO2013189052 | | 12/2013 |
| WO | WO2014005275 | | 1/2014 |
| WO | WO2014015463 | | 1/2014 |
| WO | WO 2014/061477 | A1 | 4/2014 |
| WO | WO2014140320 | | 9/2014 |
| WO | WO2014150131 | | 9/2014 |
| WO | WO2013082173 | | 10/2014 |

OTHER PUBLICATIONS

PCT International Preliminary Report on Patentability for PCT/GB2014/051333, dated Aug. 5, 2015, 12 pgs.
Application and File History for U.S. Appl. No. 14/235,210, filed Mar. 4, 2014, inventor Buchberger.
Kynol, Standard Specifications of Kynol Activated Carbon Fiber Products, published by Kynol. Date unknown.
International Search Report dated Jan. 26, 2010 for International Application No. PCT/AT2009/000414.
International Search Report and Written Opinion for International Application No. PCT/AT2012/000017 dated Jul. 3, 2012.
Translation of International Preliminary Report on Patentability dated Aug. 13, 2013 for International Application No. PCT/AT2012/000017.
Japanese Notice of Reasons for Rejection for Japanese Application No. 2015-137361 dated May 31, 2016.
Translation of IPRP dated May 1, 2014 for International Patent Application No. PCT/EP2012/070647 filed Oct. 18, 2012.
International Search Report and Written Opinion dated Feb. 6, 2013 for PCT/EP2012/070647 filed Oct. 18, 2012.
International Search Report and Written Opinion, International Application No. PCT/GB2014/051334 dated Jul. 21, 2014.
International Search Report and Written Opinion, International Application No. PCT/GB2014/051332 dated Jul. 21, 2014.
IPRP, International Application No. PCT/GB2014/051332 dated Nov. 12, 2015.
International Search Report and Written Opinion for International Application No. PCT/EP2012/003103 dated Nov. 26, 2012.
Application and File History for U.S. Appl. No. 14/888,514, filed Nov. 2, 2015, inventor Reevell.
Application and File History for U.S. Appl. No. 14/888,517, filed Nov. 2, 2015, inventor Reevell.
European Search Report for European Application No. 15178588 dated Apr. 14, 2016.
Chinese Office Action for Chinese Application No. 201480024978.X dated Jan. 18, 2017.
Russian Search Report for Russian Application No. 2015146843/12 date completed Apr. 24, 2017.
Application and File History for U.S. Appl. No. 13/125,343, filed Apr. 21, 2011, inventor Buchberger.
Application and File History for U.S. Appl. No. 14/296,803, filed Jun. 5, 2014, inventor Buchberger.
Application and File History for U.S. Appl. No. 14/353,256, filed Apr. 21, 2014, inventor Buchberger.
Application and File History for U.S. Appl. No. 14/594,065, filed Jan. 9, 2015, inventor Buchberger.
Application and File History for U.S. Appl. No. 15/307,095, filed Oct. 27, 2016, inventor Buchberger.
Application and File History for U.S. Appl. No. 15/454,156, filed Mar. 9, 2017, inventor Buchberger.
Application and File History for U.S. Appl. No. 15/470,078, filed Mar. 27, 2017, inventor Buchberger.
Application and File History for U.S. Appl. No. 15/470,089, filed Mar. 27, 2017, inventor Buchberger.
Application and File History for U.S. Appl. No. 15/470,095, filed Mar. 27, 2017, inventor Buchberger.
Chinese Notification of First Office Action for Chinese Application No. 201480031926.5 dated Apr. 21, 2017.
Chinese Office Action for Chinese Application No. 201480024988.3 dated Dec. 30, 2016.
Chinese Office Action for Chinese Application No. 201480031296.1 dated Mar. 27, 2017.
Chinese Office Action for Chinese Application No. 201480024988.3 dated Sep. 11, 2017.
Decision to Grant in Russian Application No. 120267, dated Oct. 26, 2016, 7 pages, no English translation available.
Dunn et al., Heat Pipes, 4th Edition, 1994, ISBN 0080419038, 14 pgs.
European Search Report for European Application No. 16166656 dated Oct. 11, 2016.
Great Britain Examination Report, Application No. GB1405720.2, dated Jun. 27, 2017, 3 pages.
GB Intention to Grant, Application No. GB1405720.2, dated Sep. 26, 2017, 2 pages.
International Preliminary Report on Patentability dated Apr. 26, 2011, for International Application No. PCT/AT2009/000414, 7 pages.
IPRP dated Apr. 22, 2014 for International Patent Application No. PCT/EP2012/070647 filed Oct. 18, 2012.
IPRP, International Application No. PCT/GB2014/051334 dated Nov. 12, 2015.
International Preliminary Report on Patentability for International Application No. PCT/GB2014/051688 dated Dec. 8, 2015.
IPRP for corresponding International Application No. PCT/GB2015/051213 dated Jul. 14, 2016; 21 pages.
International Search Report and Written Opinion for International Application No. PCT/GB2014/051333 dated Jul. 17, 2014.
International Search Report of the International Searching Authority for International Application No. PCT/GB2014/051633 dated Dec. 4, 2014.
International Search Report for International Application No. PCT/GB2014/051688 dated Aug. 26, 2014.
International Search Report for corresponding International Application No. PCT/GB2015/051213 dated Jul. 16, 2015; 5 pages.
Japanese Notice of Reasons for Refusal, dated Oct. 7, 2013 for Japanese Application No. 2011532464.
Japanese Notice of Reasons for Rejection dated Sep. 8, 2015 for Japanese Application No. 2014179732.
Japanese Office Action for Application No. 2016-134648 dated May 23, 2017.
Korean Office Action, Korean Application No. 10-2015-7034538, dated May 12, 2017, 10 pages.
Notice of Opposition Letter from EPO. Opposition against EP 2358418 dated Mar. 1, 2017.
Notification of Transmittal of IPRP for International Application No. PCT/GB2014/051633 dated Oct. 23, 2015.
Office Action dated Sep. 3, 2014, for Russian Application No. 2013504605.
Pulmonary Pharmacology: Delivery Devices and Medications, accessed at www.cdeu.org/cecourses/z98207/ch4.htm.
Rudolph, BAT Cigarettenfabriken GmbH, 1987, "The Influence of CO2 on the Sensory Charcteristics of the Favor-System," (Accessed at <http://legacy.library.ucsf.edu/tid/sld5f100>.
Russian Decision to Grant, Application No. 2015146845, dated Apr. 27, 2017, 8 pages.
Russian Office Action, Application No. 2015146847, dated Sep. 22, 2017, 11 pages.
Chinese First Office Action for Chinese Application No. 200980152395.4 dated Dec. 3, 2012.
Chinese Second Office Action for Chinese Application No. 200980152395.4 dated Aug. 20, 2013.
Translation of Search Report for JP2016517671 date of search Feb. 1, 2017.
Written Opinion, dated Jan. 26, 2010, for International Application No. PCT/AT2009/000414, 14 pages (with translation).
Written Opinion of the International Searching Authority for International Application No. PCT/GB2014/051633 dated Dec. 4, 2014.
Written Opinion for International Application No. PCT/GB2014/051688 dated Aug. 26, 2014.

(56) References Cited

OTHER PUBLICATIONS

Written Opinion of the International Searching Authority for corresponding International Application No. PCT/GB2015/051213 dated Jul. 16, 2015; 9 pages.
Chinese Office Action, Application No. 201480024988.3, dated Dec. 30, 2016, 9 pages (17 pages with translation).
Russian Office Action, Application No. 2016142584, dated Nov. 21, 2017, 6 pages (8 pages with translation).
Japanese Office Action, date Dec. 5, 2017, Application No. 2016-564977, 3 pages (6 pages with translation).
European Extended Report, Application No. 17189951.1, dated Jan. 4, 2018, 11 pages.
International Search Report, Application No. PCT/AT2009/000413, dated Jan. 25, 2010.

* cited by examiner

ELECTRONIC CIGARETTE

RELATED APPLICATIONS

The present application is a National Phase entry of PCT Application No. PCT/GB2014/051333, filed Apr. 30, 2014, which claims priority from GB Patent Application No. 1307966.0, filed May 2, 2013, said applications being hereby incorporated by reference herein in their entirety.

TECHNICAL FIELD

Embodiments relate to an electronic cigarette.

SUMMARY

Embodiments of electronic cigarette described herein comprise a generally cylindrical housing with a proximal mouth end and a distal end, and within the housing a vaporizer to produce vapor to be delivered to the mouth end, a battery, and sensor circuitry to detect a user drawing on the mouth end and to connect the battery to power the vaporizer to produce vapor, the vaporizer comprising a tube having inlet and outlet ends and extending longitudinally of the housing, supports at opposite ends of the tube for directing airflow into and out of the tube from the inlet to the outlet, a porous matrix containing a vaporizable liquid extending around the tube, wicking fibers extending through side openings in the tube and configured to wick the vaporisable liquid from the porous matrix into the tube, an electrical heater coil in the tube configured to be powered by the battery to vaporize liquid on the wicking fibers in the tube, so that vapor is supplied along the tube to the outlet end when the user draws thereon, and an airflow restrictor to channel the flow of air along the tube to the heater coil.

The supports for the tube may include a mouth end stopper that is push-fitted into the mouth end of the housing, which includes a mouthpiece spigot onto which the outlet end of the tube is received, and an outlet passageway extending through the spigot to provide an outlet for vapor from the tube.

Also, the supports for the tube may include an annular support member that includes a peripheral surface to engage with the interior of the housing, an inlet spigot on which the inlet end of the tube is mounted, and an inlet passageway extending through the inlet spigot to provide an inlet for air into the tube.

BRIEF DESCRIPTION OF THE DRAWINGS

Embodiments of electronic cigarettes will now be described in more detail by way of example with reference to the accompanying drawings, in which.

DETAILED DESCRIPTION

Figure 1:
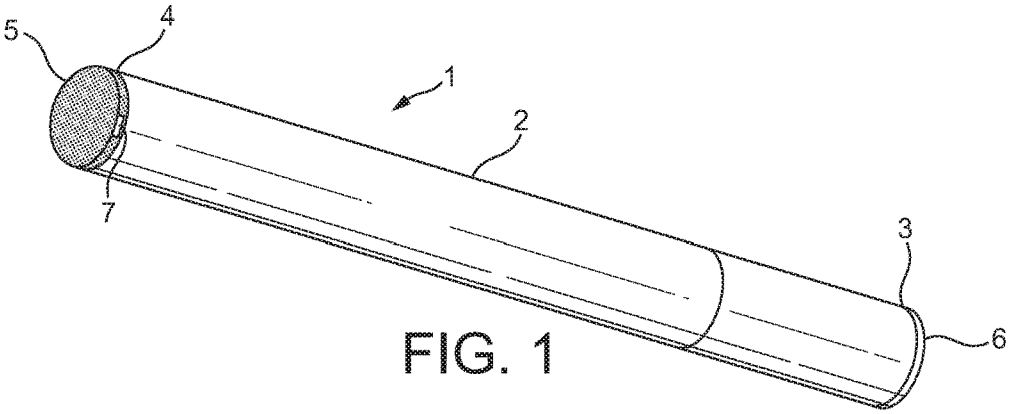
FIG. 1 is a schematic perspective view of an electronic cigarette.
Figure 2:
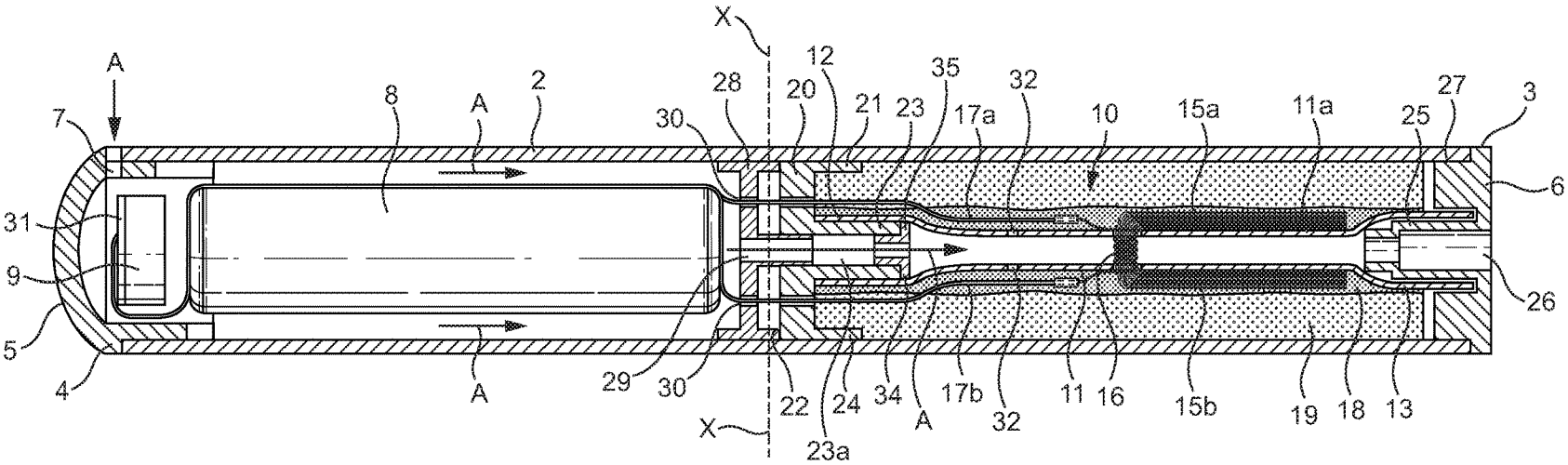
FIG. 2 is a longitudinal section through the electronic cigarette shown in FIG. 1.

Referring to FIGS. 1 and 2, an electronic cigarette 1 includes a generally cylindrical housing 2 conveniently in the form of a tube of plastics material that extends from a proximal or mouth end 3 to distal end 4. An end cap 5 of translucent plastics material is push-fitted into the distal end 4 and a mouth end stopper 6 is similarly fitted into the mouth end 3. The tube 2 is flexible and given rigidity in part by its internal components, as will be described in more detail hereinafter. The tube in one example is made of polypropylene.

As shown in FIG. 2, the end cap 5 includes an air inlet 7 so that when the user draws on the mouth end 3, air is drawn into the housing and as will be described hereinafter, vapor is supplied to the user through the mouth end 3. The housing 2 contains a battery 8, sensor circuitry 9 and a vaporizer 10 that produces a vapor to be supplied to the user.

Figure 3:
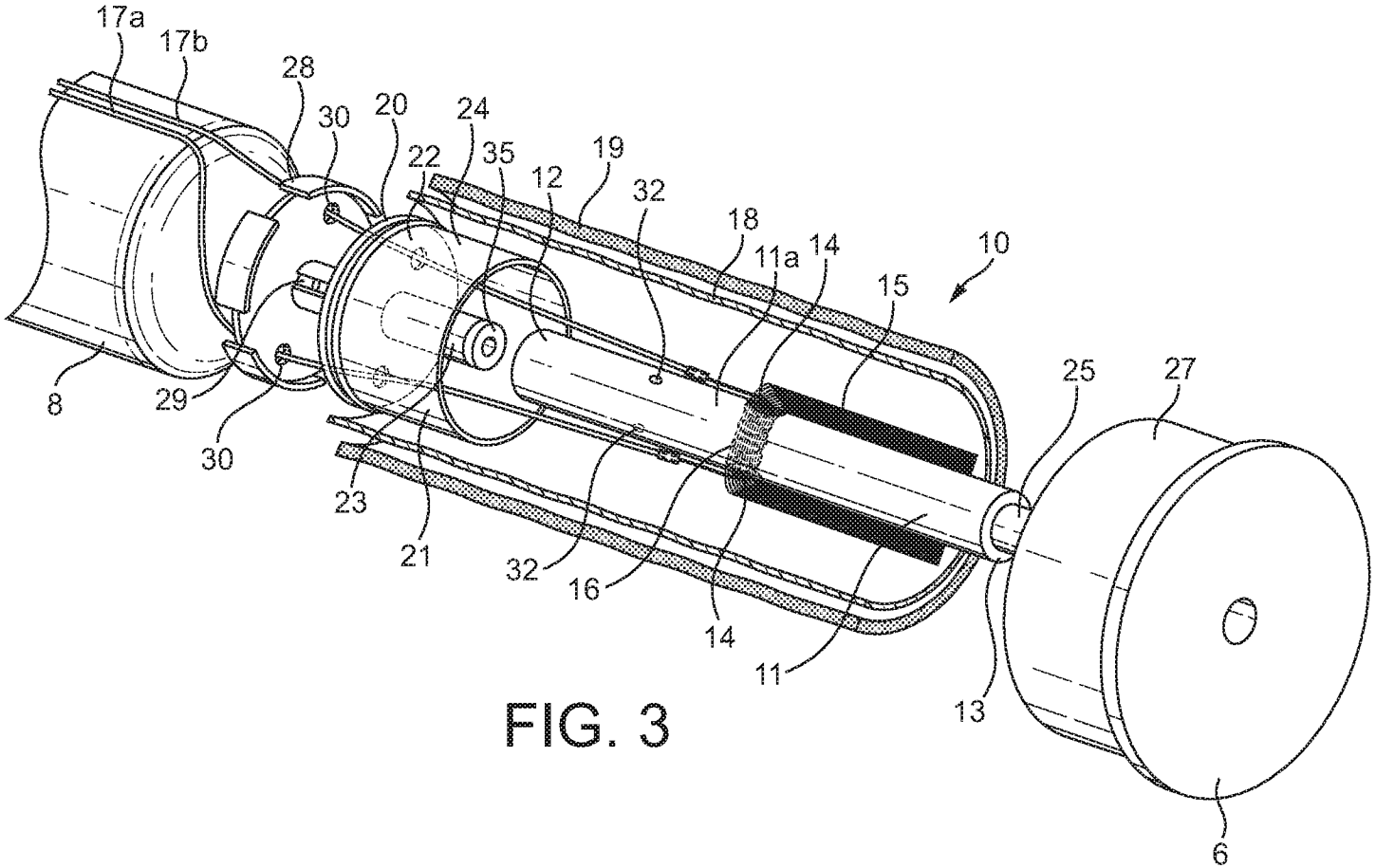
FIG. 3 is an exploded, partial perspective view of the vaporizer illustrated in FIG. 2.
Figure 4:
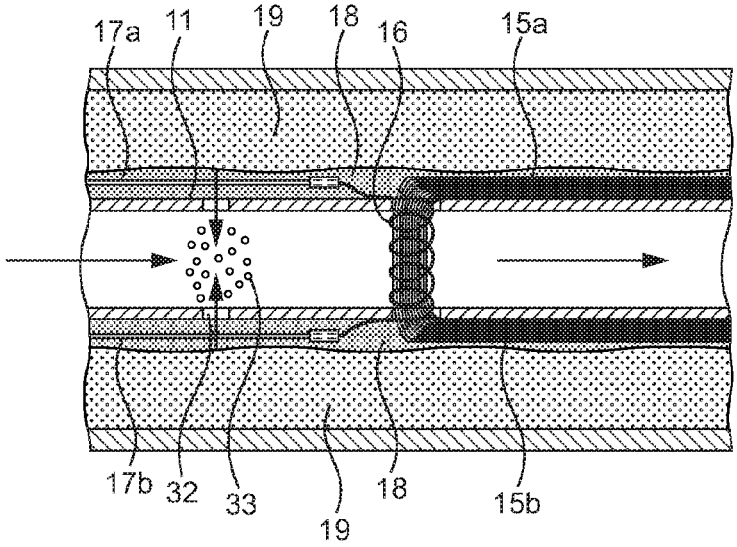
FIG. 4 is an enlarged portion of the sectional view shown in FIG. 2 in the region of its heater element.

The vaporizer 10 is illustrated in more detail in FIGS. 3 and 4. The vaporizer 10 includes a tube 11, conveniently made of fiberglass material which extends from an inlet end 12 to outlet end 13. The tube 11 has an outer surface 11*a* and includes diametrically opposed side openings 14*a*, 14*b* through which wicking fibers 15 extend, so as to extend diametrically across the interior of the tube 11 and lie along its outside on surface 11*a*. In the example shown in FIGS. 3 and 4, the fibers 15 are of a heat resistant material such as fiberglass and extend longitudinally along the outside of the tube 11 towards its outlet end 13, but the fibers 15 could extend towards the inlet end 12. Further configurations for the wicking fibers will be described hereinafter.

An electrical heater coil 16 extends diametrically across the tube 11, with the wicking fibers axially within the coil 16. Electrical leads 17*a*, 17*b* supply electrical power to the coil 16 from the battery 8 under the control of the sensor circuitry 9 shown in FIG. 2.

A porous matrix that comprises first and second sheets of fibrous material 18, 19 is loaded with a vaporizable material, for example a nicotine and glycerol solution.

The sheet 18 has a lower surface area and absorbency than the surrounding sheet 19 which can retain a larger volume of the liquid. Typically, the sheet 19 has a larger pore size than the sheet 18. The sheet 18 however facilitates transfer of the liquid to the wicking fibers 15 so that the liquid is wicked along the core of the heater coil 16.

One end of the vaporizer 10 includes an annular support member 20 that has a peripheral surface 21 that engages with the interior surface of the cylindrical housing 2. The annular support member 20 has a generally circular end face 22 extending diametrically across the housing 2 from which an axial inlet spigot 23 extends towards the mouth end 3 and receives the inlet end 12 of tube 11. The overlying ends of the sheets 18, 19 are retained between an annular, depending flange 24 and the inlet spigot 23 at the inlet end of tube 11, and generally fill the space between the interior surface of housing 2 and the tube 11. The annular support member 20 is conveniently flexible and made of silicon for example, so that it can be easily manipulated into housing 2 during manufacture. The sheets 18, 19 are wrapped around the tube 11 and thereby locate the wicking fibers 15 along the length of the outer surface of the tube 11. Spigot 23 includes a through hole to provide an air inlet passageway 23*a* into the tube 11.

A mouth end stopper 6 includes a mouthpiece spigot 25 that receives the outlet end 13 of tube 11. The end stopper 6 includes an axial outlet passageway 26 through the spigot to pass vapor to a user through the mouth end 3 of housing 2. Also, the mouth end stopper 6 includes a depending flange 27 so that the stopper 6 can be push-fitted into the mouth end 3 of housing 2. The outlet end 13 of tube 11 may extend slightly beyond the matrix 18, 19. Thus there is a gap between the matrix and the mouth end 3 of the housing 2. Also, the mouthpiece spigot 25 which extends into the tube outlet end 13 is longer than the depending flange 27 that engages with the housing 2 so as to provide a gap between the porous matrix 18, 19 and the end stopper 6. This arrangement prevents or reduces leakage of the liquid held in the sheets 18, 19 through the mouth end 3 of the housing. Thus, the annular support member 20 and the mouth end stopper 6 with their respective spigots 23, 25 cooperate with the tube 11 and the housing 2 to provide a sealed plenum containing the porous sheets 18, 19 so as to retain the nicotine containing liquid in the sheets 18, 19 without significant leakage, and to allow the liquid to wick along wicking fibers 15 to be vaporized on operation of the heater coil 16.

A washer 28, conveniently made of rigid plastics material such as polypropylene, is provided between the vaporizer 10 and battery 8 to provide rigidity to the housing 2 in the region of the annular support member 20. The washer 28 includes an air passageway opening 29 and also openings 30 which receive the electrical leads 17*a*, 17*b*. The tubular housing 2 thus is relatively rigid to the touch of the user's fingers in the region of the battery 8 and the washer 28 but is more resilient to the touch in the region containing the vaporizer 10 to provide characteristics of tactility that are similar to those of a conventional tobacco containing cigarette.

An air passageway extends from the inlet openings 7 in the end cap 5 between the sensor circuitry 9 and battery 8 to the air passageway 29 in the washer 28 and thence to the inlet 12 of tube 11.

The sensor circuitry 9 may include a light source in the form of LED 31 which, when operated, is visible through the translucent end cap 5.

When the user draws on the mouth end 3, air is drawn through the air inlet 7 in the direction of arrow A past the battery 8 and into the tube 11. The drawing action reduces the air pressure within the housing 2, which is sensed by the sensor circuitry 9. In response, electrical power from the battery 8 is switched by the sensor circuitry 9 to pass through leads 17*a*, 17*b* and energize heater coil 16. As a result, liquid which has been wicked by the wicking fibers 15 from the surrounding porous matrix layers 18, 19 is heated and thereby vaporized so that a stream of nicotine containing vapor is passed through the outlet passageway 26 for the user. Also, in response to the pressure reduction, the sensor circuitry illuminates the LED 31 to mimic the burning of a conventional tobacco containing cigarette.

Also, referring to FIGS. 3 and 4, atomization apertures 32 are formed in the tube 11 so that when the user draws on the mouth end 3, the resulting pressure reduction in tube 11 draws liquid from the surrounding porous matrix layers 18, 19 through the apertures 32 and as a result, the liquid is atomized, thereby producing an atomized stream 33 shown in FIG. 4. In this example, the atomization apertures 32 are provided between the inlet end 12 of tube 11 and the heater coil 16 so that the atomized droplets 33 then pass the heater 16, which encourages further vaporization of the atomized liquid.

Typically, the atomization apertures 32 are of a diameter between 0.1-0.5 mm. In the example of FIG. 3, the atomization apertures 32 are shown diametrically opposite one another but other configurations are possible, for example a distributed arrangement along the tube 11, which may be spatially uniform or otherwise. Also, one or more of apertures 32 may be provided downstream of the heater coil 16, towards the outlet end of the tube 11.

Figure 5:
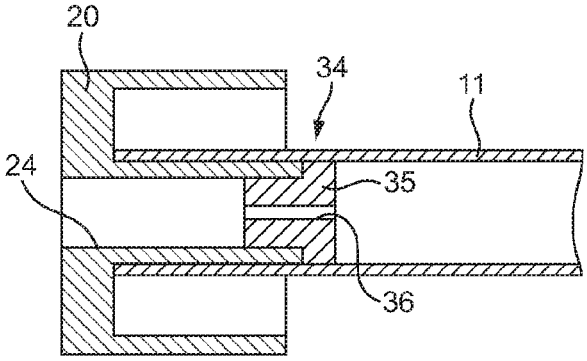
FIG. 5 is a sectional view of an airflow restrictor plug shown in FIG. 2.

A flow restrictor 34 is provided to accelerate the airflow that passes the heater coil 16. In the electronic cigarette shown in FIG. 2, the flow restrictor comprises an airflow restrictor plug 35 that is press fitted into an end of the airflow passageway through spigot 23 of the annular support member 20. As shown in more detail in FIG. 5 the airflow restrictor plug 35 includes an axial restrictor bore 36 of a smaller cross sectional area than the tube 11 that channels the air drawn through the inlet end 12 of the tube which can improve the vaporization of liquid from the wicking fibers 15 by the heater coil 16. The resistance to draw is also increased by the presence of the airflow restrictor plug 35, which may improve the consumer experience when drawing on the mouthpiece end 3. In one example, the cross sectional area of the restrictor bore 36 is between 10%-60% of the cross sectional area of the tube 11, to provide the aforesaid advantages, although not all embodiments are specifically restricted to this range.

Figure 6:
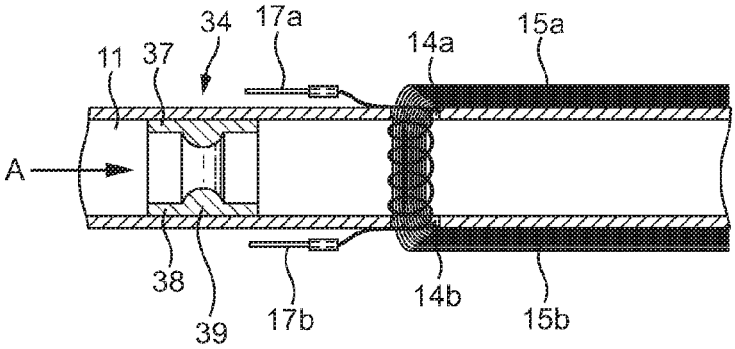
FIG. 6 is a sectional view of an airflow restrictor ring.

The flow restrictor 34 can be provided in the airflow at other locations upstream of the heater coil 16, and an example is shown in FIG. 6. In this example, the flow restrictor 34 comprises a restrictor ring 37 that includes a generally cylindrical body 38 that can be slid into the tube 11, with a flow restriction orifice 39 to channel the flow, the orifice 39 having cross sectional area between 10%-60% of the cross sectional area of the tube 11 in some embodiments, to provide the aforesaid advantages.

Figure 7A:
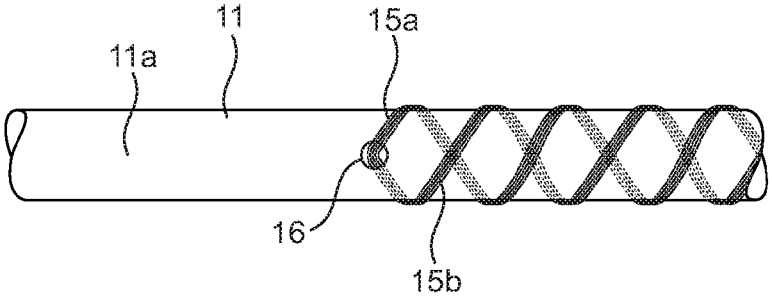
FIGS. 7A and 7B illustrate different wrappings for the wicking fibers around the vaporizer tube.
Figure 7B:
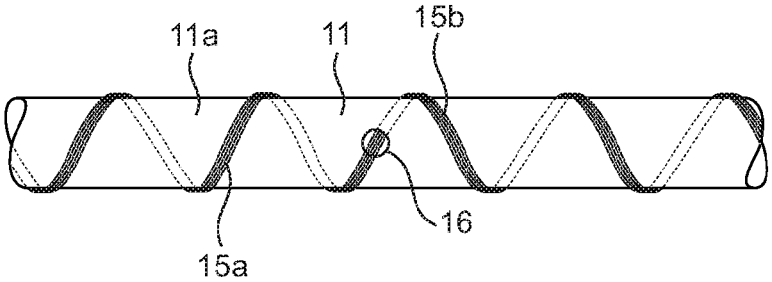

As previously mentioned, the wicking fibers 15 may be disposed in a number of different configurations along the outer surface 11*a* of the tube 11. In the example shown in FIG. 7A, the fibers 15 are wrapped in a spiral pattern around the outer surface 11*a* of the tube 11 towards both its inlet end 12 and outlet end 13. In this example, fibers 15*a* extending out of side opening 14*a* are wound in a spiral towards the outlet end 13, and fibers 15*b* extending out of side opening 14*b* are wound in a spiral towards the inlet end 12, with the same hand as fibers 15*a*. However, other winding patterns can be used. For example as shown in FIG. 7B, the fibers 15*a*, 15*b* are both wound in a spiral pattern towards the outlet end 13 of the tube 11, with opposite hands.

Other winding patterns can be used such as a serpentine pattern around the outer surface 11*a* of tube 11. Also the fibers 15*a* and/or 15*b* could be divided into bunches and each wound differently around the tube 11, with the same or different winding patterns in the same or different directions along the tube 11, with the same or different hands.

The wrapping of the fibers 15 around the outer surface 11*a* of the tube improves the operation of the vaporizer 10 by increasing their contact area with the sheet 18.

Figure 8A:
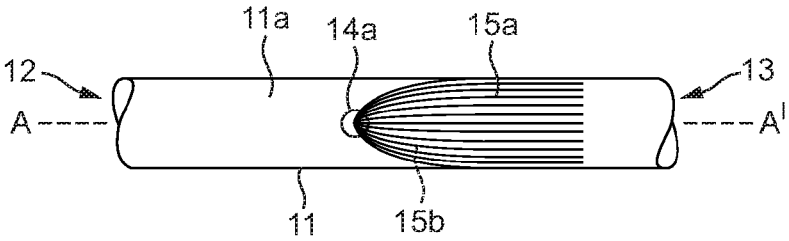
FIGS. 8A, 8B and 8C illustrate different fanned, spread configurations for the wicking fibers.

Also, the wicking fibers may be arranged in a spread configuration as shown schematically in FIG. 8A for example. The fibers 15 diverge from one another from the side openings 14*a*, 14*b* into generally fan shaped, spread regions 15*a*, 15*b* which lie on the curved outer surface 11*a* of the tube 11. In the example shown in FIG. 8A, the fan shaped, spread regions 15*a*, 15*b* both extend from the side openings 14*a*, 14*b* towards the outlet end 13 of tube 11.

Figure 8B:
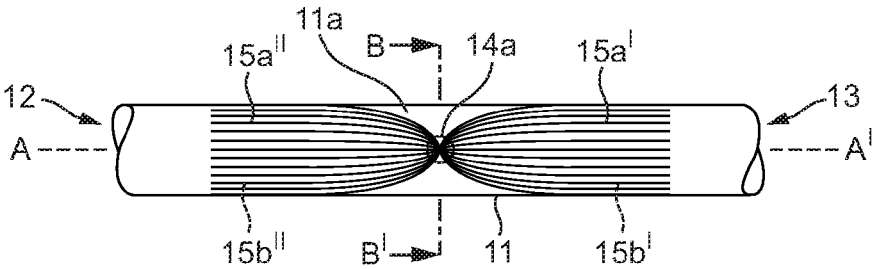
Figure 8C:
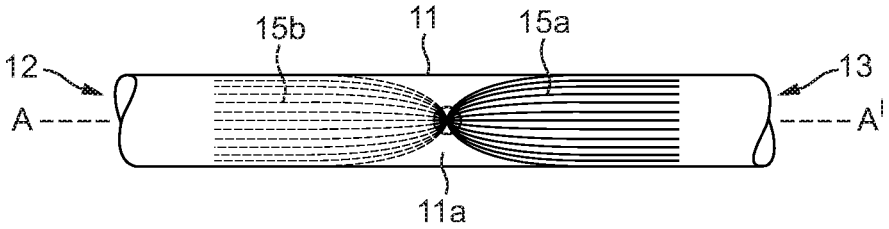

Alternative spread wicking fiber configurations are shown in FIGS. 8B and 8C. In FIG. 8B, the fibers 15 emanating from side opening 14*a* are split into two bundles 15*a*' and 15*a*" which diverge from the opening 14*a* in opposite directions along the outer surface 11*a* of the tube 11. The fibers 15*b* emanating from opening 14*b* can be similarly split into two bundles 15*b*' and 15*b*" which diverge from the opening 14*b* in opposite directions along the outer surface 11*a* of the tube 11.

In FIG. 8C, the fibers 15*a* emanating from side opening 14*a* diverge from the side opening along the outer surface 11*a* of the tube 11 towards its outlet end 13. The fibers 15*b* emanating from opening 14*b* diverge from the opening 14*b* along the outer surface 11*a* of the tube 11 toward the inlet end 12.

It will be appreciated that various permutations of the various wicking fiber spreading arrangements shown in FIGS. 8A, 8B and 8C can used for the different fiber groupings. In the illustrations of FIGS. 8A, 8B and 8C the spread wicking fibers are all configured so as be spread symmetrically of the central longitudinal axis of symmetry A-A' of the tube 11 but it will be appreciated that asymmetrical wicking fiber configurations can also be used.

Figure 9:
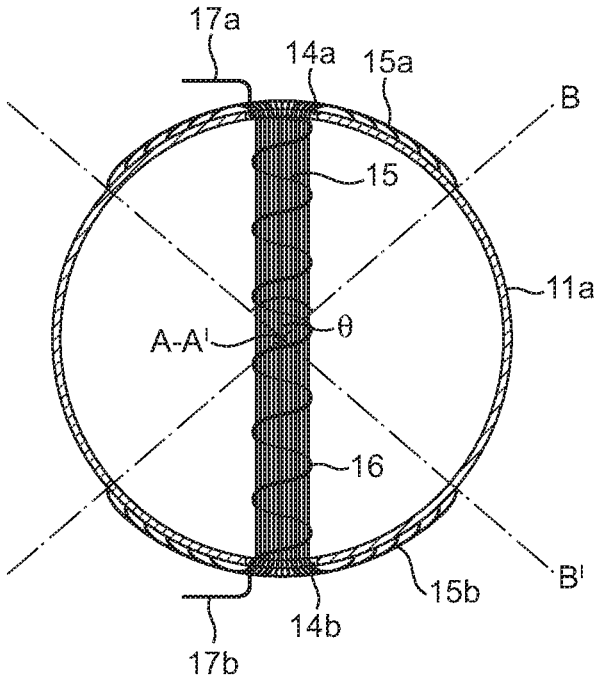
FIG. 9 is a sectional view through the arrangement shown in FIG. 8B along the line B-B'.

The spread configuration of the wicking fibers 15 over the outer surface 11*a* of the tube also improves the operation of the vaporizer 10. Referring to FIG. 9, which shows a transverse section through the tube 11 shown in FIG. 8A, the fibers 15 are shown threaded through the coil 16 and diverging into the generally fan shaped spread regions 15*a*, 15*b* around the outer surface 11*a* of the tube 11. The outermost or largest circumferential spread of the fan shaped spread wicking fiber region 15*a* subtends an angle θ with the central longitudinal axis A-A' of the tube 11 and improved wicking occurs when the maximum value of 0 is at least 30°, i.e., the angle θ subtended by the widest part of the fan shaped region 15*a* 0≥30°, such as 40°≤θ≤150°. The fiber region 15*b* is similarly spread in FIG. 6 but a different value of 0 could be used falling within the aforesaid range. Also the angle θ can be considered as the azimuth in polar coordinates from the axis A-A' such that the azimuth corresponding to the widest part of the fan shaped region falls within the aforesaid range.

Figure 10:
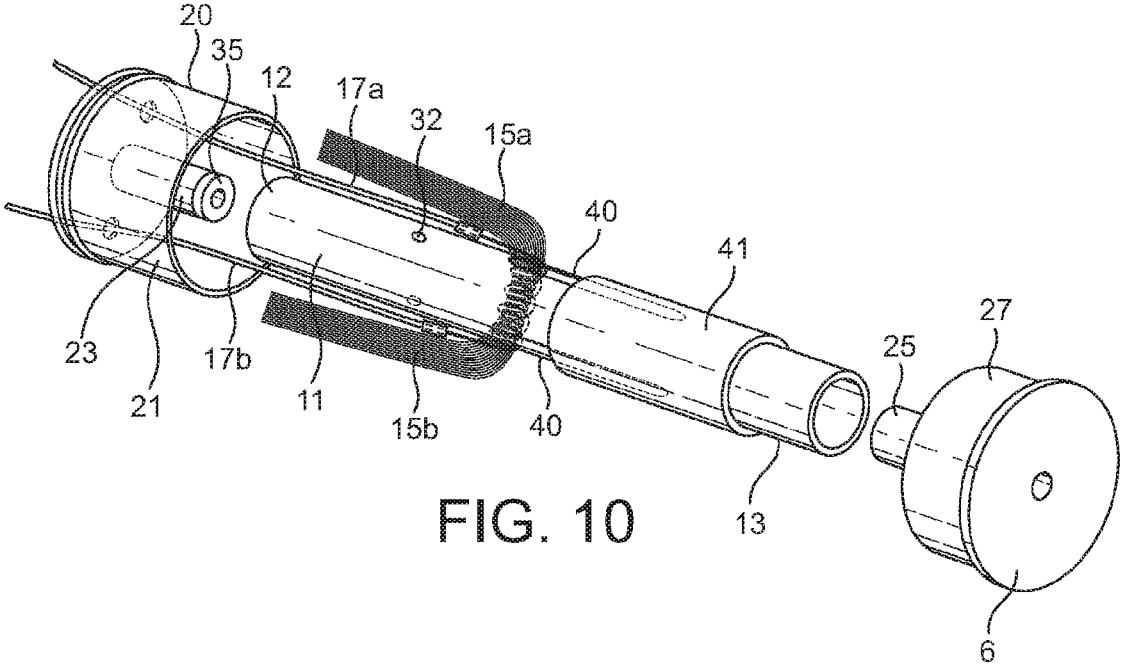
FIG. 10 is an exploded, partial perspective view of an alternative vaporizer.

A modified arrangement is illustrated in FIG. 10 with an alternative form of side openings to receive the wicking fibers 15. The coil 16 can be slid into an elongate slot 40 formed in tube 11 which is then closed by means of an overlying cylindrical sheath 41 that is conveniently is made of fiberglass material so as to have similar properties to tube 11, which is slid into place from outlet end 13. In this example, the wicking fibers 15 extend towards the inlet opening 12 of tube 11 rather than the outlet end 13, with the advantage that their ends can be sandwiched between the tube 11 and the porous matrix sheet, and held firmly between the tube 11 on spigot 23 and the depending flange 24 of the annular support member 20.

In another modification, the device shown in FIGS. 1 and 2 may have a two part housing 2 so that the vaporizer 10 is attached to the battery 8 and sensor circuitry 9 by a releasable coupling (not shown) along hatched line X shown in FIG. 2.

In order to address various issues and advance the art, the entirety of this disclosure shows by way of illustration various embodiments in which the claims may be practiced and provide for a superior electronic cigarette. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An electronic cigarette comprising a generally cylindrical housing with a proximal mouth end and a distal end, and within the housing:

a vaporizer to produce vapor to be delivered to the mouth end;

a battery; and sensor circuitry to detect a user drawing on the mouth end and connect the battery to power the vaporizer to produce vapor, the vaporizer comprising:

a tube having inlet and outlet ends and extending longitudinally of the housing, first and second supports at opposite ends of the tube for directing airflow into and out of the tube from the inlet to the outlet, wherein the first support is located at the inlet end of the tube and the second support is located at the outlet end of the tube, a vaporizable liquid holder containing a vaporizable liquid extending around the tube, wicking fibers extending through side openings in the tube and configured to wick the vaporizable liquid from the vaporizable liquid holder into the tube, an electrical heater coil in the tube configured to be powered by the battery to vaporize liquid on the wicking fibers in the tube, so that vapor is supplied along the tube to the outlet end when the user draws thereon, and an airflow restrictor to channel and accelerate the flow of air along the tube towards a central portion of the heater coil, wherein the airflow restrictor is located in the tube between the first support and the heater coil.

2. An electronic cigarette according to claim 1 wherein the airflow restrictor has a restriction orifice with a cross sectional area of between 10%-60% of the cross sectional area of the tube.

3. An electronic cigarette according to claim 1 wherein the airflow restrictor comprises an airflow restrictor ring located in the tube between the inlet end and the heater coil.

4. An electronic cigarette according to claim 1 wherein the first support comprises an annular support member including a peripheral surface to engage with the interior of the housing, an inlet spigot on which the inlet end of the tube is mounted, and an inlet passageway extending through the inlet spigot to provide an inlet for air into the tube.

5. An electronic cigarette according to claim 4 wherein the airflow restrictor is within the inlet passageway.

6. An electronic cigarette according to claim 5 wherein the airflow restrictor comprises an airflow restrictor plug in the inlet passageway.

7. An electronic cigarette according to claim 4 wherein the annular support member includes a depending peripheral flange such that the vaporizable liquid holder is retained between the spigot and the flange.

8. An electronic cigarette according to claim 7 wherein ends of the wicking fibers are retained sandwiched between the tube and the vaporizable liquid holder between the spigot and the flange.

9. An electronic cigarette according to claim 4 including a washer between the annular support member and the battery.

10. An electronic cigarette according to claim 1 wherein the second support comprises a mouth end stopper that is push-fitted into the mouth end of the housing, the mouth end stopper including a mouthpiece spigot onto which the outlet end of the tube is received, and an outlet passageway extending through the spigot to provide an outlet for vapor from the tube.

11. An electronic cigarette according to claim 10 including a gap between the vaporizable liquid holder and the end stopper.

12. An electronic cigarette according to claim 1 including an air inlet opening at the distal end of the housing.

13. An electronic cigarette according to claim 12 including an air feed passageway between the battery and the housing, extending from the air inlet opening to the inlet end of the tube.

14. An electronic cigarette according to claim 1 wherein the sensor circuitry is disposed between the battery and the distal end of the housing.

15. An electronic cigarette according to claim 1 including a light source powered by the battery under the control of the sensor circuitry to be illuminated in response to the user drawing on the mouth end.

16. An electronic cigarette according to claim 15 wherein the light source is disposed at the distal end of the housing.

17. An electronic cigarette according to claim 1 including an end cap push fitted into the distal end of the housing.

18. An electronic cigarette according to claim 1 wherein the housing comprises a first part containing the battery releasably coupled to a second part containing the vaporizer.

19. An electronic cigarette according to claim 1 wherein the vaporizable liquid holder comprises inner and outer sheets of overlying fibrous material, with outer sheet having a greater pore size than the inner sheet for wicking the liquid to the inner sheet by capillary action.

20. An electronic cigarette according to claim 1 including an atomization aperture in the tube configured to allow liquid to be drawn into the tube from the vaporizable liquid holder so as to be atomized by passage through the aperture when the user draws on the mouth end.

* * * * *